US005303701A

United States Patent [19]

Heins et al.

[11] Patent Number: 5,303,701

[45] Date of Patent: Apr. 19, 1994

[54] BLOWER-SUPPORTED GAS MASK AND BREATHING EQUIPMENT WITH AN ATTACHABLE CONTROL PART

[75] Inventors: Bodo Heins, Bad Schwartau; Torsten Birenheide, Krummesse, both of Fed. Rep. of Germany

[73] Assignee: Dragerwerk AG, Lubeck, Fed. Rep. of Germany

[21] Appl. No.: 952,683

[22] Filed: Sep. 25, 1992

[30] Foreign Application Priority Data

Oct. 7, 1991 [DE] Fed. Rep. of Germany ..... 4133235

[51] Int. Cl.[5] ..... A62B 7/10; A62B 18/10; A62B 23/02

[52] U.S. Cl. ..... 128/206.17; 128/205.12; 128/204.22

[58] Field of Search ..... 128/206.17, 204.22, 128/204.18, 205.12

[56] References Cited

U.S. PATENT DOCUMENTS 5,018,518 5/1991 Hübner ..... 128/206.17

FOREIGN PATENT DOCUMENTS 0164946 12/1985 European Pat. Off. ..... A62B 7/10

2221164 1/1990 United Kingdom ..... 128/201.25

*Primary Examiner*—Edgar S. Burr

*Assistant Examiner*—Katharina Trautman

*Attorney, Agent, or Firm*—McGlew and Tuttle

[57] ABSTRACT

A gas mask and breathing equipment with a respirator, to the respiration gas inlet of which a respiration gas filter and a respiration supporting blower unit are connected, is formed such that the components controlling the power output are arranged in areas that are favorable for operation and are able to control the blower unit in the case of a filter change or during changes in the state of loading of the built-in filters during operation such that they can be adapted to the changing performance characteristics. The housing of the blower unit (2) has a saddle-shaped upper part (5), over which a control unit (7), designed as an independent housing module, can be attached in a bow-like manner, and establishes the electrical and pneumatic connections to the blower unit.

10 Claims, 2 Drawing Sheets

BLOWER-SUPPORTED GAS MASK AND BREATHING EQUIPMENT WITH AN ATTACHABLE CONTROL PART

FIELD OF THE INVENTION

The present invention pertains to a gas mask and breathing equipment, and more particularly to the respiration gas inlet of which a particle filter or respiration gas filter and a blower unit supporting respiration are connected, wherein the blower unit is provided with electrical leads for electrical power supply.

BACKGROUND OF THE INVENTION

Such a gas mask and breathing equipment has become known from EP-A-164,946. In this prior-art gas mask and breathing equipment, the respirator is directly connected to both the blower unit and the filter, wherein the blower unit and the filter are aligned, in terms of flow, in an axial direction to one another. The fan part of the blower unit, which supports the delivery of respiration gas during inspiration, is arranged, in terms of flow, behind the filter as a respiration gas-generating fan wheel, but it may also be installed in front of the filter in terms of flow, in which case the fan part presses the respiration gas through the filter and into the respiration gas inlet of the respirator. In both cases, the energy supply for the fan part is led out of the blower unit via electrical lines, and is further led to a separate power supply unit (battery, control unit for controlling the blower power, and monitoring of the battery functions), which is attached as a separate component, e.g., to the belt of the user of the gas mask and breathing equipment. To monitor the blower unit for proper function, a pressure sensor is provided, which switches the blower unit on and off under defined circumstances via a switch. Both the sensor and the switch are attached in an appropriate area within the mask body, and their electrical connection to the power supply unit is established via separate cables.

It is disadvantageous in the prior-art arrangement that each of the control components necessary for monitoring the blower unit is connected separately to both the blower unit and to the power supply unit, and that after replacement of filters with different respiration gas resistances, the monitoring elements (pressure sensor and switch) cannot be adapted to the new conditions, e.g., flow resistance and output.

SUMMARY AND OBJECTS OF THE INVENTION

The primary object of the present invention is to improve a gas mask and breathing equipment of the above-described type such that the blower output can be controlled independently of the type of filter used and the filter use time according to predetermined set values, and the components controlling the blower output can be arranged in areas favorable for the operation, and the blower unit can be adapted to the changed output parameters in the case of filter replacement or during changes in the state of loading of the built-in filters during operation.

This task is accomplished by the housing of the blower unit having a an arcuate or curved upper part, over which a control unit, whose external dimensions are adapted to the contours of the upper part and which integrates the switching elements for the operation of the blower unit in an independent housing module, can be attached in a bow-like manner, and is brought into connection with the electrical leads via electrical contact devices.

The advantage of the present invention is essentially the fact that the housing module for the control part can be separately attached to the upper part of the blower unit, and it contains, in its interior, the components necessary for the operation and the wiring of the blower unit. Regardless of the type of filter used, the motor speed of the fan part can be monitored according to predetermined performance data and can be readjusted, if desired. The necessary blower output, which can be transmitted via a speed presetting unit to the fan part of the blower unit and monitored, can be programmed in a memory within the control unit. The fan part may be a radial or axial blower, which is driven by an electric motor. It can be ensured by various codings that the control unit needed for the respiration gas filter being used will be used. In the simplest case, such a coding consists of a color marking of the control unit, which is identical to the corresponding marking of the respiration gas filter. The flow resistance increases with increasing filter load, so that the increased power consumption of the motor for the fan part is controlled correspondingly. This can be achieved by an output control device within the control unit.

If a full facepiece mask with an eye-protective lens is used as part of the gas mask and breathing equipment, it is advantageous to directly connect the upper part to the mask body, in which case the blower unit with its fan part forms the respiration inlet, and the upper part is arranged in the extension of the center line of the eye-protective lens above the respiration gas inlet. The user of the mask is now able to immediately recognize in a simple manner whether the blower unit is provided with the control unit necessary for the operation.

A simple coupling of the control unit to the upper part can be achieved by the upper part having a semicylindrical shape, over which the horseshoe-shaped control unit, which surrounds the upper part, can be attached.

To establish the electrical connection, it is favorable to arrange the electrical leads to terminate as metallic contact pads on the surface of the housing of the blower unit. In appropriate areas, the control unit has contact pins which project from the surface of the housing and are pressed onto the contact pads when the control unit is attached. The type and number of the contact pins and the corresponding contact pads can also be incorporated in a further coding for a suitable combination of the control unit and the respiration gas filter.

To monitor the output of the blower unit, it is advantageous to provide a pressure line starting from the fan part of the blower unit and extending to the surface of the housing of the blower unit, which ends in a line opening there, which can be brought into pressure-tight connection with a pressure inlet when the housing module of the control unit has been attached. From this inlet, the pressure line proceeds to a pressure sensor within the control unit, so that the delivery pressure can always be measured and monitored. When a pressure limit, which indicates, e.g., complete loading of the respiration gas filter, is exceeded, an acoustic and/or optical warning is produced. In the simplest case, the pressure sensor is formed by a housing which is divided in two by a diaphragm, and one housing part is connected to the pressure line, and the other housing part is connected to the environment. A magnet, which is moved together with the diaphragm depending on the prevailing pressure conditions, is located on the diaphragm. The position of the magnet and consequently the instantaneous pressure are converted by a holding element into an electrical signal. If, for example, the output of the fan part of the blower unit is no longer sufficient to ensure a sufficient excess pressure in the respiration gas inlet, a pressure drop is generated with each breath, and the pressure drop will trigger a warning when a value that is typically 0.1 mbar is reached. Thus, the control unit operates as an indicating unit, both during normal operation and in the case of failure, when the fan part fails, by the warning device being triggered by a simple resistance recognition.

For better attachment and for securing against shocks, it is favorable to provide the housing of the blower unit with detents, into which corresponding stop recesses of the control unit attached to the upper part will snap.

The fact that the control unit contains a sensor element which responds to the composition of the respiration gas to be delivered can be considered to represent a considerable expansion in terms of the complete monitoring of the performance capacity of the blower unit and of the filtering efficiency of the respiration gas filter. The gas-sensitive measuring surface of the sensor element is led out to the surface of the housing module via a gas sample line to a measuring gas opening and is brought into gastight connection with a measuring gas line in the blower unit when the housing module has been attached. The measuring gas line extends within the blower unit to the respiration gas inlet, through which the respiration gas is delivered. Depending on the filter used, the sensor element responds to gas components within the respiration gas which are to be retained by the filter. As the loading of the respiration gas filter with the pollutant to be retained increases, pollutants may pass through the respiration gas filter, unnoticed by the user of the gas mask and breathing equipment, and these pollutants are already detected by the substantially more sensitive sensor element. A corresponding warning indicates the incipient breakthrough of gas through the filter, so that the user of the gas mask and breathing equipment can either replace the used filter with a new one or withdraw from the danger zone in time. All warning indications can be arranged, in the form of warning lights, in the visual range of the user of the gas mask and breathing equipment, so that he is able to recognize any warning through the eye-protective lens of a full facepiece mask.

An electrochemical measuring cell has proven to be particularly suitable for use as a sensor element, because it is characterized by extremely low power consumption.

The control unit can be arranged as an independent housing module on a corresponding upper part of the blower unit in the case of both full facepiece masks and half masks, without having to change the characteristics of the present invention or without diminishing the advantages of the present invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
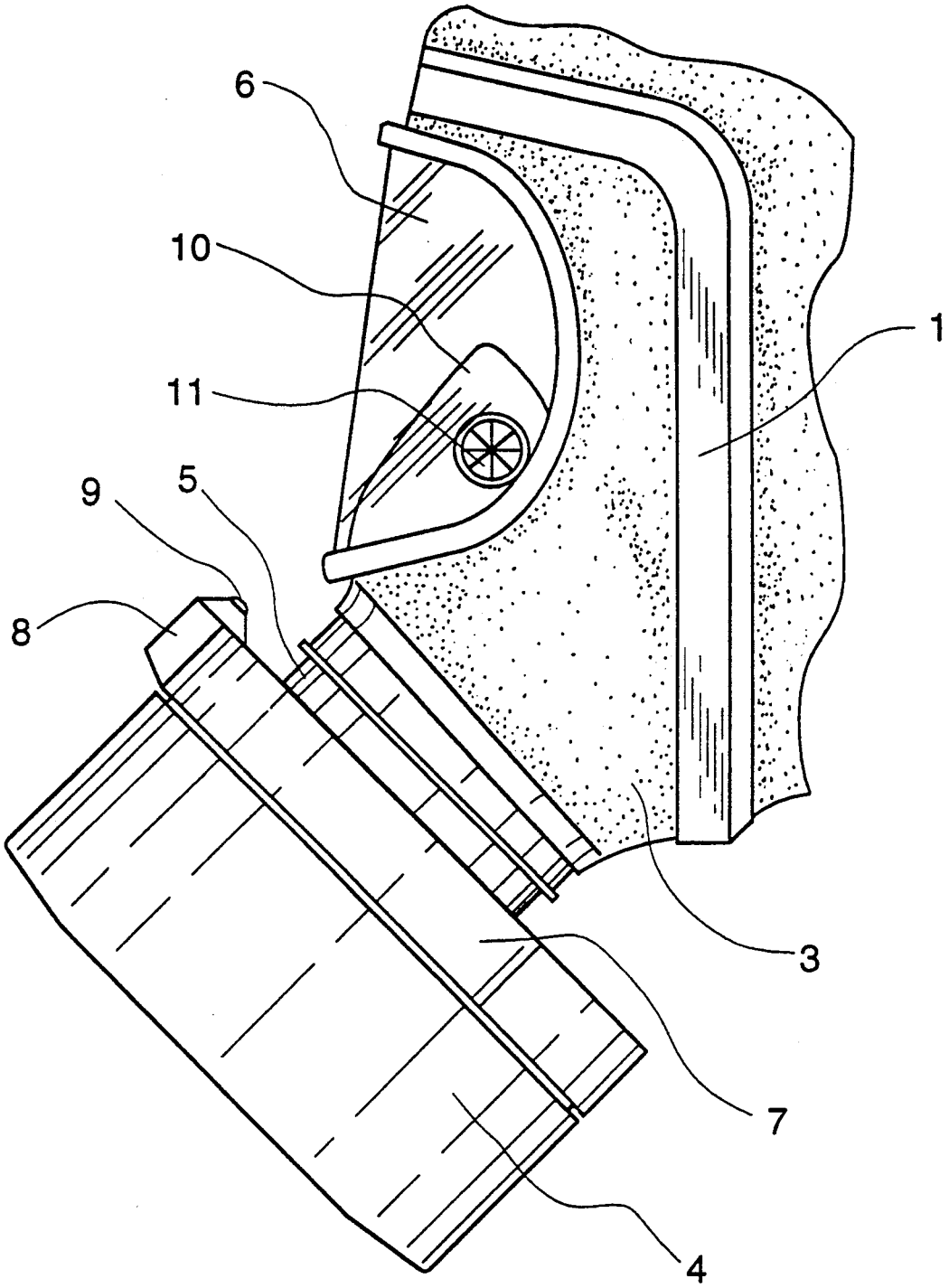
FIG. 1 is a schematic side view of a gas mask and breathing equipment with the control unit attached.

FIG. 1 shows a gas mask and breathing equipment which includes, in connection with a mask body in the form of a full facepiece mask 1, a blower unit 2 which is connected to the respiration gas inlet 3 of the mask 1, on the one hand, and a respiration gas filter 4, on the other hand. The blower unit 2 is consequently located, in terms of flow, between the respiration gas filter 4 and the respiration gas inlet 3. The blower unit 2 has a semicylindrical upper part 5, which is arranged in the extension of the center line of an eye-protective lens 6 of the full facepiece mask 1 in the visual range of the user of the gas mask and breathing equipment. A control unit in the form of a housing module 7 is attached above the upper part 5 in a bow-like manner and is brought into mechanical and electrical contact with the blower unit 2. In an elevated area 8, a warning light 9 points toward the eye-protective lens 6. When the full facepiece mask 1 is attached, an inner half mask 10 with the control valve 11 comes to lie around the nose and mouth area of the user of the gas mask and breathing equipment (not shown).

Figure 2:
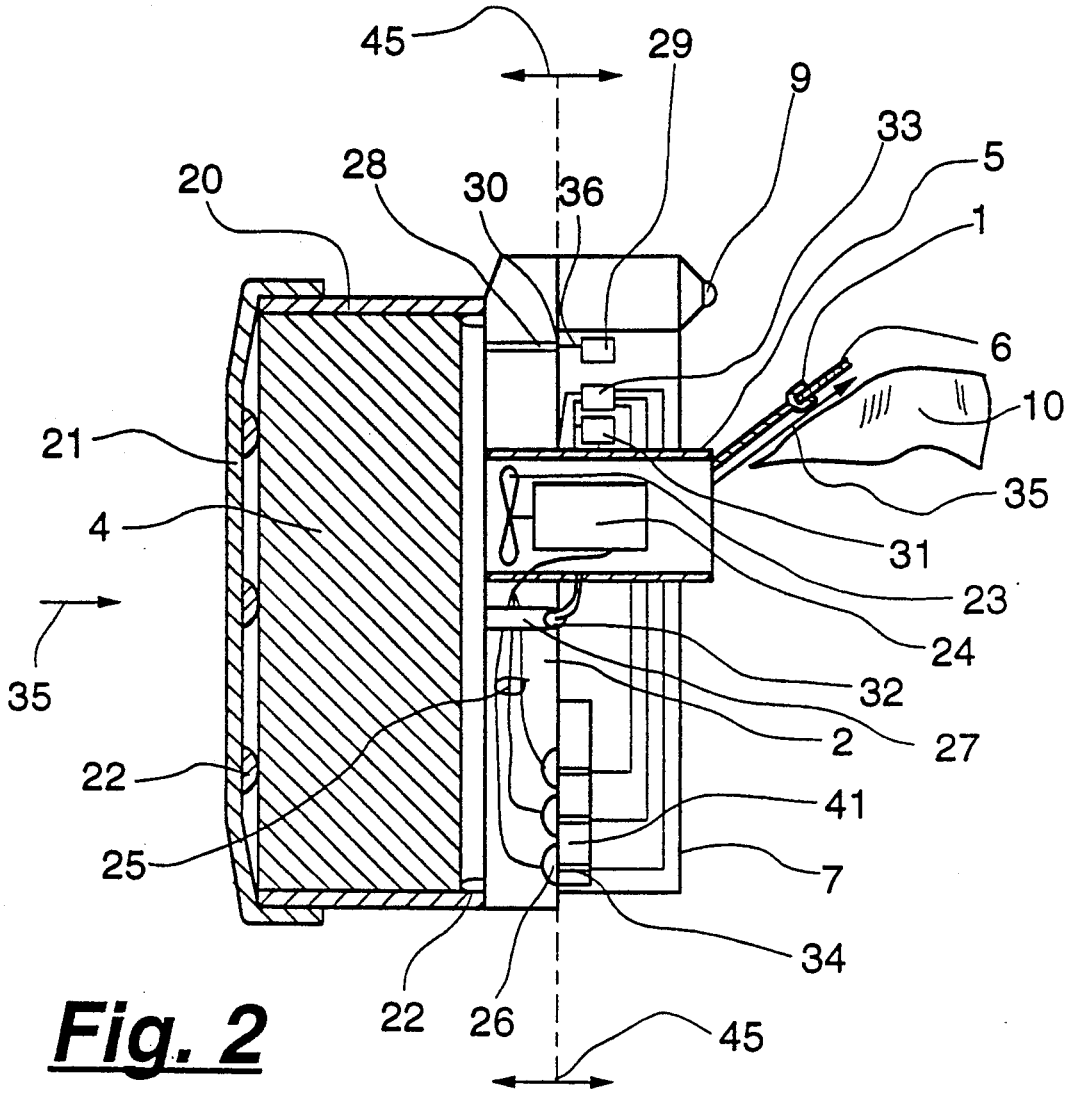
FIG. 2 is a partial sectional view taken through the gas mask and breathing equipment according to FIG. 1.

The partial section shown in FIG. 2 contains the respiration gas filter 4 in a filter housing 20. The respiration gas filter 4 is brought into flow connection, with a cover 21 which is permeable to the respiration gas, with the blower unit 2. Firm fitting of the filter 4 is provided by sealing pads 22. The blower unit 2 comprises a fan part 23 in the form of an axial blower that is connected to an electric motor 24. From the electric motor 24, the necessary (electrical leads) 25 lead to metallic contact pads 26, which are arranged on the surface of the blower unit 2. The blower unit 2 also contains a pressure line 27, which is connected to the inside of the filter housing 20 and also opens on the surface of the blower unit 2, as well as a measuring gas line 28, which is likewise connected to the inside of the filter housing 20 and opens on the surface of the blower unit 2. The housing module 7 of the control unit, which is attached to the upper part 5 of the blower unit 2, comprises a sensor element 29, which is designed as an electrochemical gas sensor and whose gas sample line 36 is caused to overlap, at its measuring gas opening 30, the measuring gas line 28, as well as a pressure sensor 31, whose pressure inlet 32 is connected to the opening of the pressure line 27 in a pressure-tight manner. A central microprocessor 33 provides switching elements, the microprocessor 33 is connected to the contact pads 26 via contact pins 34, on the one hand, and, via connection lines, not shown, to both the pressure sensor 31, the gas sensor 29, and the warning light 9, on the other hand. The respiration gas flow is indicated by the direction arrows 35. The double arrows 45 indicate the separation line between the control unit housing module 7, on one hand, and the blower unit 2 connected to the filter housing 20, on the other hand.

Figure 3:
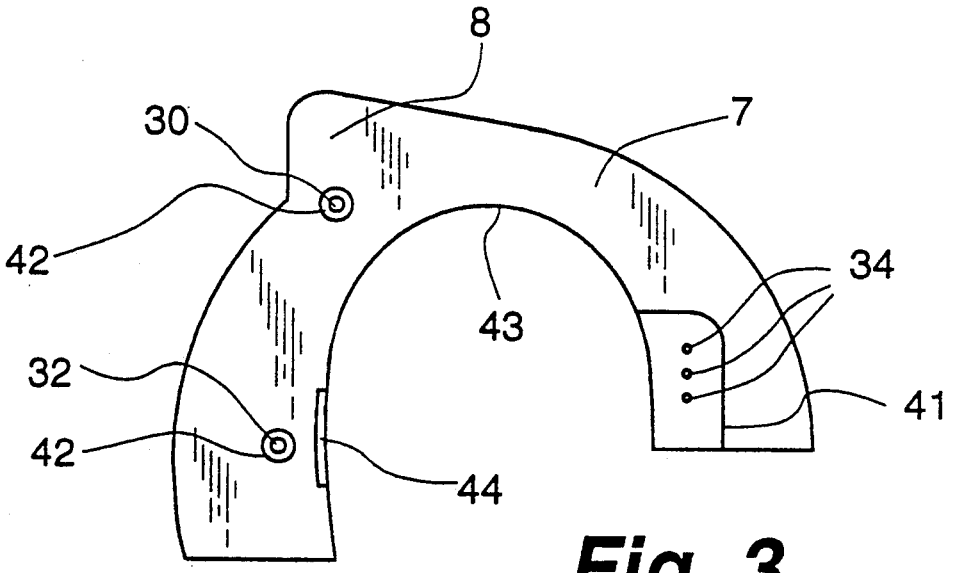
FIG. 3 is a plan view of the housing module for the control unit on the lateral surface which is to be brought into connection with the blower unit.

FIG. 3 shows a view the housing module 7 of the control unit, which is of a horseshoe-shaped design, in which, in the attached state, it is brought into contact with the blower unit 2. Three the contact pins 34 project from a depression 41 and form the terminal connection to the contact pads 26. The measuring gas opening 30 continues to the sensor 29 and is surrounded with a silicone seal 42. The delivery pressure inlet 32 is located under it and is also surrounded by a silicone seal 42. The contour 43 of the housing module 7, which is adapted to the semicylindrical shape of the upper part 5, has a stop recess 44, into which a detent (not shown) of the blower unit 2, having a complementary shape, snaps. The elevation 8 carries the warning light 9 on its rear side, which is not recognizable.

While a specific embodiment of the invention has been shown and described in detail to illustrate the application of the principles of the invention, it will be understood that the invention may be embodied otherwise without departing from such principles.

What is claimed is:

1. A gas mask breathing equipment arrangement, comprising:

a mask body;

a respiration supporting blower unit directly connected to said mask body, said respiration supporting blower unit including electrical leads for electric power supply;

a filter connected to said respiration supporting blower unit, said blower unit including a housing having an arcuate upper receiving part; and a control unit in the form of a housing module independent of said respiration supporting blower unit, said housing module having external dimensions with an arcuate surface corresponding to said arcuate upper receiving part, said control unit including switching elements for operation of said blower unit, said blower unit including electrical contact devices, said switching elements being brought into connection with said electrical leads via said electrical contact devices upon connection of said housing module with said upper receiving part.

2. A gas mask and breathing equipment according to claim 1, wherein:

said mask body is formed as a full face piece mask with an eye protective lens, said blower unit being directly connected to said mask body, said blower unit having a respiration gas inlet and including a fan part adjacent to said respiration gas inlet, said upper receiving part being arranged extending from a center line of said eye protective lens above said respiration gas inlet.

3. A gas mask and breathing equipment according to claim 1, wherein:

said control unit housing module has a horseshoe-shaped opening which surrounds said upper receiving part when said control unit housing module is attached to said blower unit.

4. A gas mask and breathing equipment according to claim 1, wherein:

said electrical contact devices are arranged as contact pads on a surface of said blower unit housing, said control unit housing module having contact pins opposite said contact pads and in contact therewith when said control unit housing module is attached to said blower unit.

5. A gas mask and breathing equipment according to claim 2, wherein:

a pressure line is provided in connection with said respiration gas inlet, said control unit independent housing module being provided with a delivery pressure inlet which is connected to a pressure sensor and brought into a pressure-tight connection with an opening of said pressure line when said control unit housing module is attached.

6. A gas mask and breathing equipment according to claim 2, wherein:

said control unit housing module includes a warning light arranged at an elevation above said upper receiving part positioned in a visual range of said protective lens.

7. A gas mask and breathing equipment according to claim 2, wherein:

said control unit housing module includes a sensor element for detecting a composition of gas delivered by said fan part, a gas sample line and a measuring gas opening formed in said control unit housing module said sensor element extending out of a surface of said control unit housing module via said gas sample line to said measuring gas opening, a measuring gas line is provided in said blower unit, said gas sample line extends in a gas-tight connection with said measuring gas line in said blower unit upon attachment of said control unit housing module to said blower unit.

8. A gas mask and breathing equipment according to claim 7, wherein:

said sensor element is an electrochemical sensor sensitive to a specific gas component retained by said respiration gas filter.

9. A gas mask breathing equipment arrangement, comprising:

a mask body;

a respiration supporting blower unit directly connected to said mask body, said blower unit including electrical leads for electric power supply and having an upper curved surface defining a receiving part;

a filter connected to said blower unit;

a control unit formed as a housing module independent of said blower unit, said housing module having an external dimension corresponding to an external dimension of said blower unit and having a lower curved surface conformed to said upper curved surface of said receiving part, said control unit including switching elements for operation of said blower unit, said switching elements being brought into connection with said electrical leads via said electrical contact devices upon connection of said housing module with said receiving part.

10. A gas mask breathing equipment arrangement according to claim 9, wherein said receiving part is of a semi-cylindrical shape and said housing module is horseshoe shaped defining a horseshoe shaped opening.

* * * * *